US008308315B2

(12) United States Patent
Grisolia et al.

(10) Patent No.: US 8,308,315 B2
(45) Date of Patent: Nov. 13, 2012

(54) HAND-HELD GLOW WRITING APPARATUS

(75) Inventors: Nick Grisolia, Lake Geneva, WI (US); Peter Greenley, Lake Geneva, WI (US)

(73) Assignee: G2 Inventions, LLC, Lake Geneva, WI (US)

( * ) Notice: Subject to any disclaimer, the term of this patent is extended or adjusted under 35 U.S.C. 154(b) by 435 days.

(21) Appl. No.: 12/786,815

(22) Filed: May 25, 2010

(65) Prior Publication Data

US 2010/0245531 A1 Sep. 30, 2010

Related U.S. Application Data

(63) Continuation-in-part of application No. 12/731,800, filed on Mar. 25, 2010.

(60) Provisional application No. 61/163,709, filed on Mar. 26, 2009.

(51) Int. Cl.
*B43K 29/10* (2006.01)

(52) U.S. Cl. ..... 362/118; 347/109; 358/1.9

(58) Field of Classification Search ..... 362/118; 347/109, 237; 358/1.9
See application file for complete search history.

(56) References Cited

U.S. PATENT DOCUMENTS

| | | | | |
|---|---|---|---|---|
| 4,717,928 | A | 1/1988 | Lans et al. | |
| 4,916,489 | A | 4/1990 | Takeda et al. | |
| 6,434,340 | B1 | 8/2002 | Behrens | |
| 6,552,740 | B1 | 4/2003 | Wong et al. | |
| 6,764,184 | B1 | 7/2004 | Carkner | |
| 6,917,447 | B2 * | 7/2005 | Boqart et al. | 358/1.9 |
| 6,930,759 | B2 | 8/2005 | Roddy et al. | |
| 7,042,483 | B2 | 5/2006 | Wong et al. | |
| 7,369,268 | B2 | 5/2008 | Oehlbeck et al. | |
| 2005/0195591 | A1 * | 9/2005 | Garcia et al. | 362/118 |

* cited by examiner

*Primary Examiner* — Lam S Nguyen
(74) *Attorney, Agent, or Firm* — Adam K. Sacharoff

(57) ABSTRACT

A hand-held glow writing apparatus constructed for use with an ultraviolet sensitive surface to produce images that glow in the dark and will fade over a time period. The device including a plurality of LED lights arrange in a parallel line. The device includes a selector switch for electively choosing an image pattern stored on a memory. The LED lights when activated, turn on and off in accordance with a predetermined sequence timed for a movement of the writing apparatus across ultraviolet sensitive surface whereby the selected image pattern will imprint an image on the ultraviolet sensitive surface that fades over the time period.

6 Claims, 12 Drawing Sheets

HAND-HELD GLOW WRITING APPARATUS

CROSS REFERENCE TO RELATED APPLICATION

The present application in a continuation in part of U.S. patent Ser. No. 12/731,800 filed Mar. 25, 2010 and entitled Inkjet Cartridge Pen, which is a nonprovisional application of U.S. Patent 61/163,709 filed Mar. 26, 2009, both of which are incorporated in their entireties by reference.

FIELD OF THE INVENTION

The present invention relates generally to a hand held light pen having an series of LED lights which when used over a particular piece of paper will leave behind an image which fades over time.

BACKGROUND OF THE INVENTION

The use of pens, paints, and airbrushes are common the issue is the use of these devices at night or in the dark and the fact that the ink is applied to the paper is almost always permanent. The advantage of the present invention is that the images applied to the paper or substrate fade over time. In addition, the present invention has a particular advantage as the light glows in the dark, allowing its use at nighttime. Based on the above, it would therefore be advantageous to provide a hand-held drawing apparatus that could draw lines, shapes or other objects on a substrate that fades over time making the apparatus more particularly enjoyable for kids and children.

SUMMARY OF THE INVENTION

One embodiment of the present invention there is provided a hand-held glow writing apparatus 100 is constructed for use with an ultraviolet sensitive surface 200 to produce images 210 that glow in the dark and will fade over a time period. The device 100 includes a microcontroller 134 having at least a memory and a predetermined timing sequence program. The memory is capable of storing at least one image pattern. An LED array 120 is positioned on an end of the apparatus 100. The LED array 120 has at least one column of a plurality of LED lights 122 arrange in a parallel line. A plurality of discrete drivers 184 separately coupled to the LED lights 120 are selectively actuatable by the microcontroller 134 for activating the LED lights. A selector switch is provided 114 for electively choosing one of the at least one image patterns stored on the memory. In addition, an activation switch 116 is provided for selectively actuating the discrete drivers to activate the LED lights in accordance with the predetermined timing sequence, such that the LED lights will flash on and off in a sequence timed for a movement of the writing apparatus across ultraviolet sensitive surface whereby the selected image pattern will imprint an image on the ultraviolet sensitive surface that fades over the time period.

In another embodiment, a hand-held glow writing apparatus 100 is constructed for use in combination with an ultraviolet sensitive surface 200 to produce images that glow in the dark and will fade over a time period. The combination includes the hand-held glow writing apparatus 100, that would have a microcontroller with at least a memory and a predetermined timing sequence program. The memory storing at least two image patterns. The apparatus includes a device image switch, which when triggered selectively chooses an image pattern stored on the memory. An activation switch is also provided for selectively activating the LED lights in accordance with the predetermined timing sequence, such that the LED lights will flash on and off in a sequence timed for a movement of the writing apparatus across ultraviolet sensitive surface whereby the selected image pattern will imprint an image on the ultraviolet sensitive surface that fades over the time period. In addition, there is provided the ultraviolet sensitive surface having at least one surface image switch embedded under an image representation. The image representation corresponding to an image stored on the memory in the hand-held glow writing apparatus, wherein when the device image switch moves into proximity to the surface image switch, the surface image switch triggers the device image switch such that when the activation switch is actuated, the writing apparatus will imprint the image corresponding to the image representation.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1A:
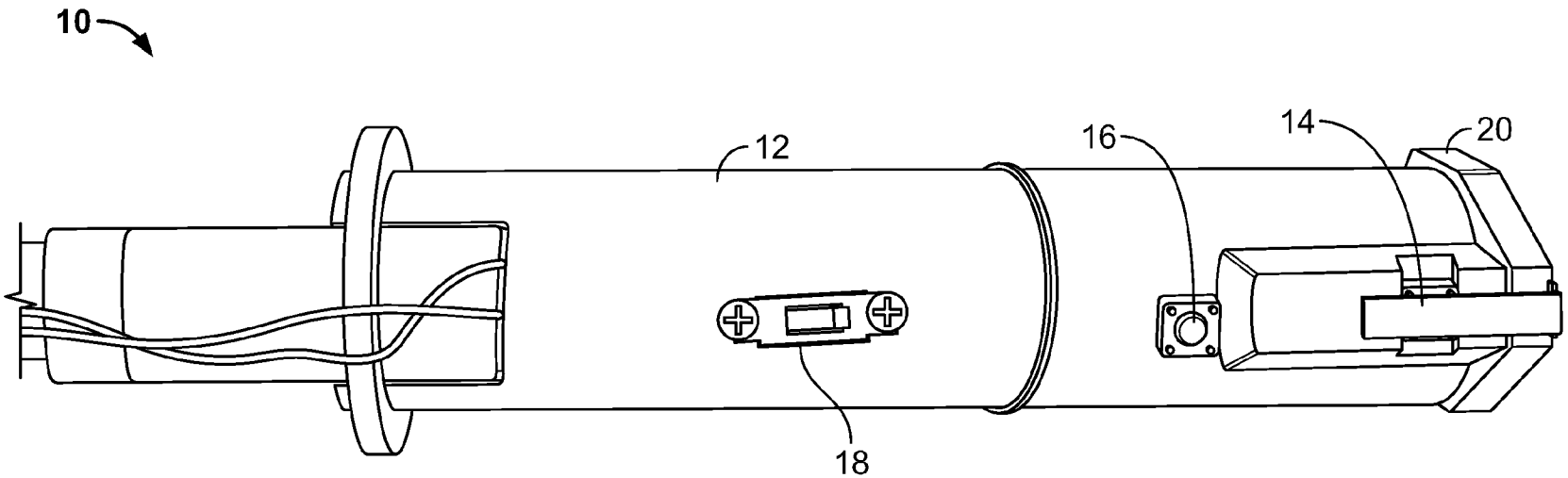
FIG. 1A is a top view of a device made in accordance with the one embodiment of the present invention.

While the invention is susceptible to embodiments in many different forms, there are shown in the drawings and will described herein, in detail, the preferred embodiments of the present invention. It should be understood, however, that the present disclosure is to be considered an exemplification of the principles of the invention and is not intended to limit the spirit or scope of the invention and the embodiments illustrated.

Figure 1B:
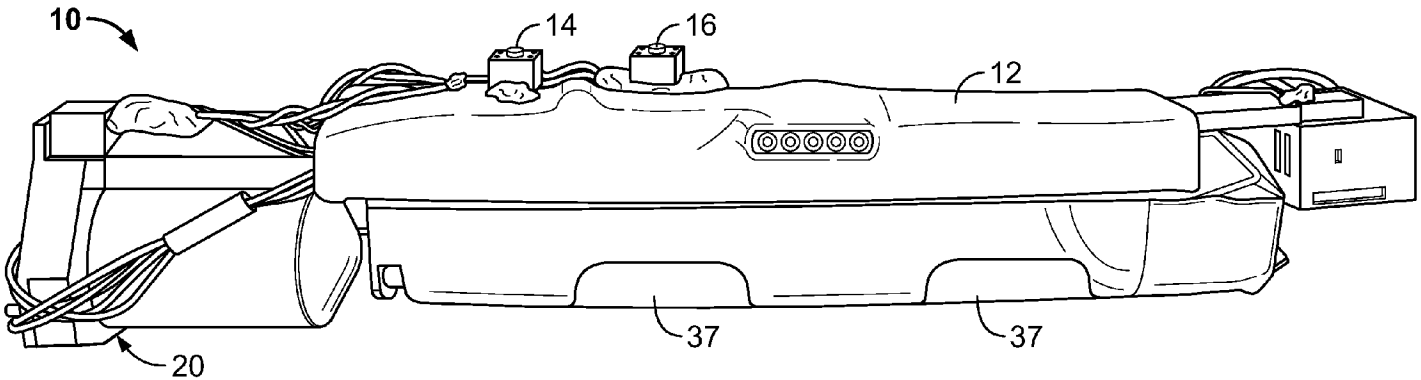
FIG. 1B is a side view of the device made in accordance with the one embodiment of the present invention.
Figure 1C:
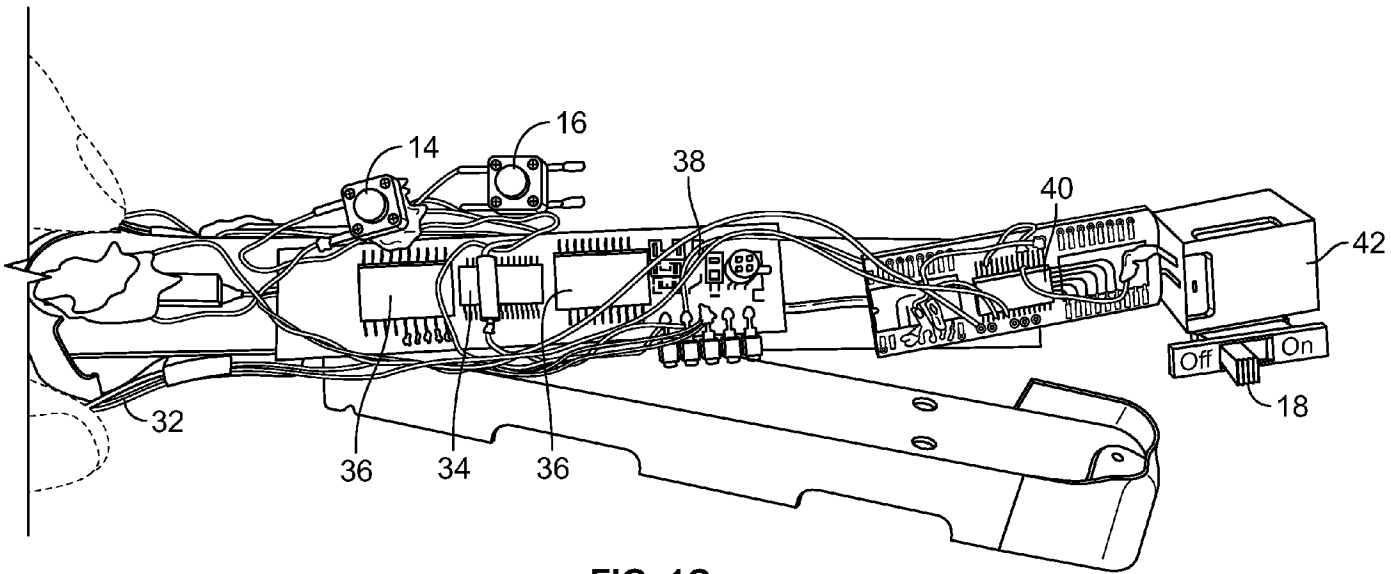
FIG. 1C is a side view of the device illustrating the internal hardware components in accordance with the one embodiment of the present invention.

Referring now to FIGS. 1A through 1C, a preferred embodiment of a hand held digital airbrush device 10 comprises, in general, a housing 12, a trigger switch 14, a pattern selector switch 16, an on/off switch 18, and a removably inkjet print cartridge 20. As further disclosed herein below, the device 10 uses an inkjet cartridge which when in communication with a internal microcontroller can be controlled to spray bitmapped images, text, or can be used as an airbrush that has complete control over the amount of ink, width of ink swath, and even color.

In order to operate the device 10, a replaceable ink jet print/cartridge 20 is placed in the housing 12. Such a print/cartridge is shown in more detail in FIG. 2. The print/cartridge 20 is adapted to be disposable or refillable when empty of ink and in general comprises an ink supply reservoir (not shown), cover member 22 which covers the ink reservoir and coarsely positions the print head assembly 23 in housing 12. The print head assembly 23 comprises a driver plate 24 having a plural of electrical leads 25 formed thereon. The leads 25 extend from connector pads 26 to resistive heater elements (not shown) located beneath orifice plate 27. Ink from reservoir is supplied to a location beneath each orifice 29 of plate 27 (and above the heater element for that orifice). Upon application of an electrical print pulse to a terminal pad by the printer control, the corresponding resistive heater element causes an ink vaporization condition which ejects an ink droplet from its corresponding orifice 29 for printing. The orifice plate 27 can be electroformed using photofabrication techniques to provide precisely located orifices and is attached to driver plate 23, which is in turn affixed to the cover member 22. The print/cartridge 20 has a self-contained ink supply and thermal jet resistors that, when energized, cause the ejection of an ink droplet from the orifice 29.

To help with the targeting of the ink a laser or LED 30 through a simple lens with a fixed focal point could illuminate a dot on the surface where the ink will be sprayed. The dot would also change size depending on the distance from the surface. So as the device 10 is pulled back from the surface its print area grows as well as the dot size, to indicate the area the spray will cover.

A battery pack or power supply 37 is provided within the housing 12 to provide power to the microcontroller 34. A removable end cap (not shown) is provided on housing 12 to facilitate replacement of the battery 37. If desired, a permanent rechargeable battery may be employed for battery 37. In some applications, it may be desirable to use an external power source instead of battery 37 although this would limit the mobility of the operator to some extent, compared to the FIG. 1A embodiment.

Figure 2:
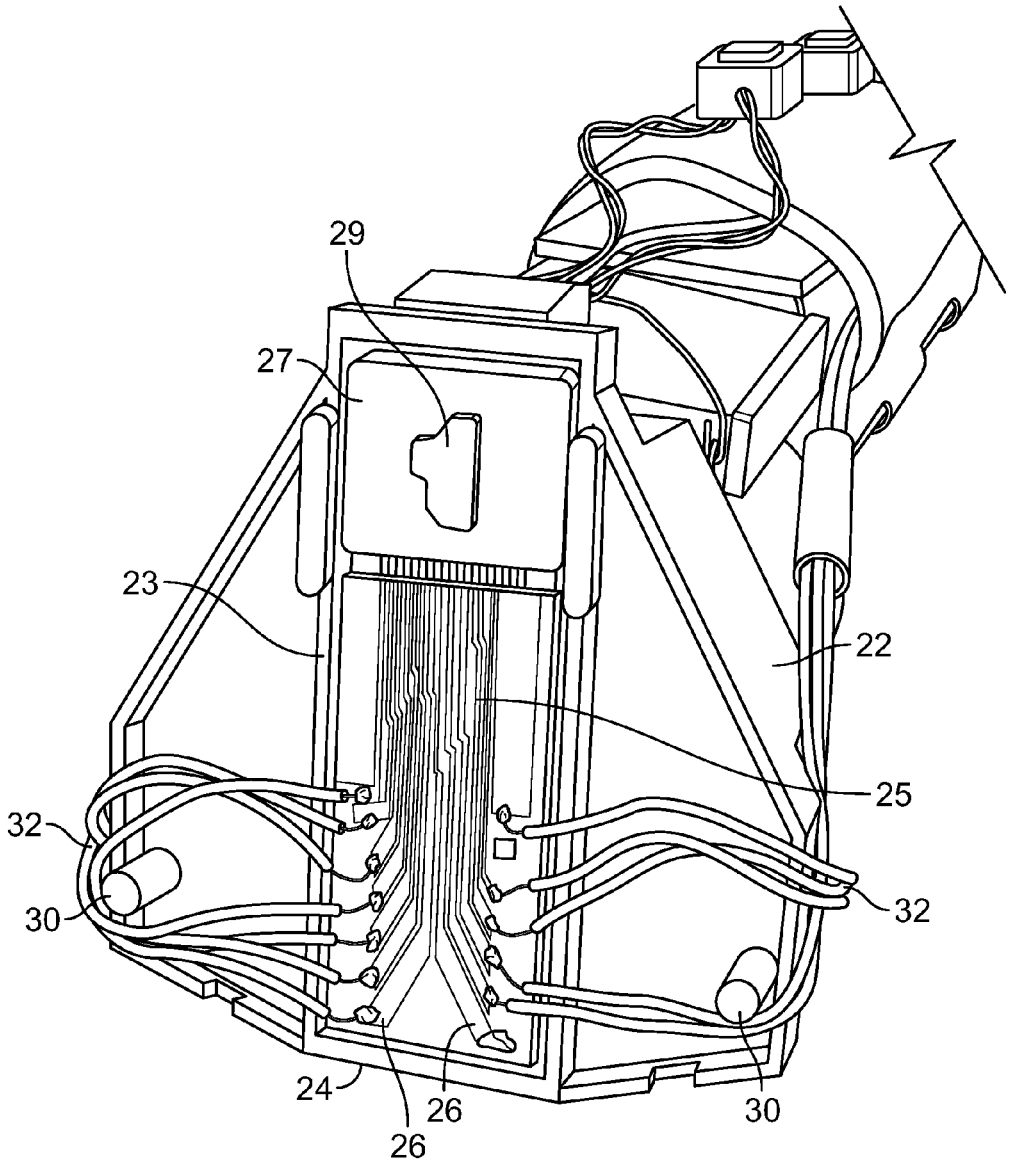
FIG. 2 is a view of one print/cartridge construction useful in accord with the present invention.

As currently illustrated in FIG. 2, connector pads 26 are attached to wires 32 that are in communication with and controlled by a microcontroller 34, shown in FIG. 1C. The microcontroller 34 controls and communicates with the various components of the device 10, including the on/off switch 18, the pattern selector 16, the spray switch 14, inkjet drivers 36, a boosting regulator 38, and a USB chip 40 and USB port connector 42. The boosting voltage regulator 38 converts standard battery voltage to the 24V required by the ink jet cartridge. The ink jet cartridge may be a 51604a or any other thermal or piezo inkjet cartridge, monochromatic or multicolor.

Figure 3:
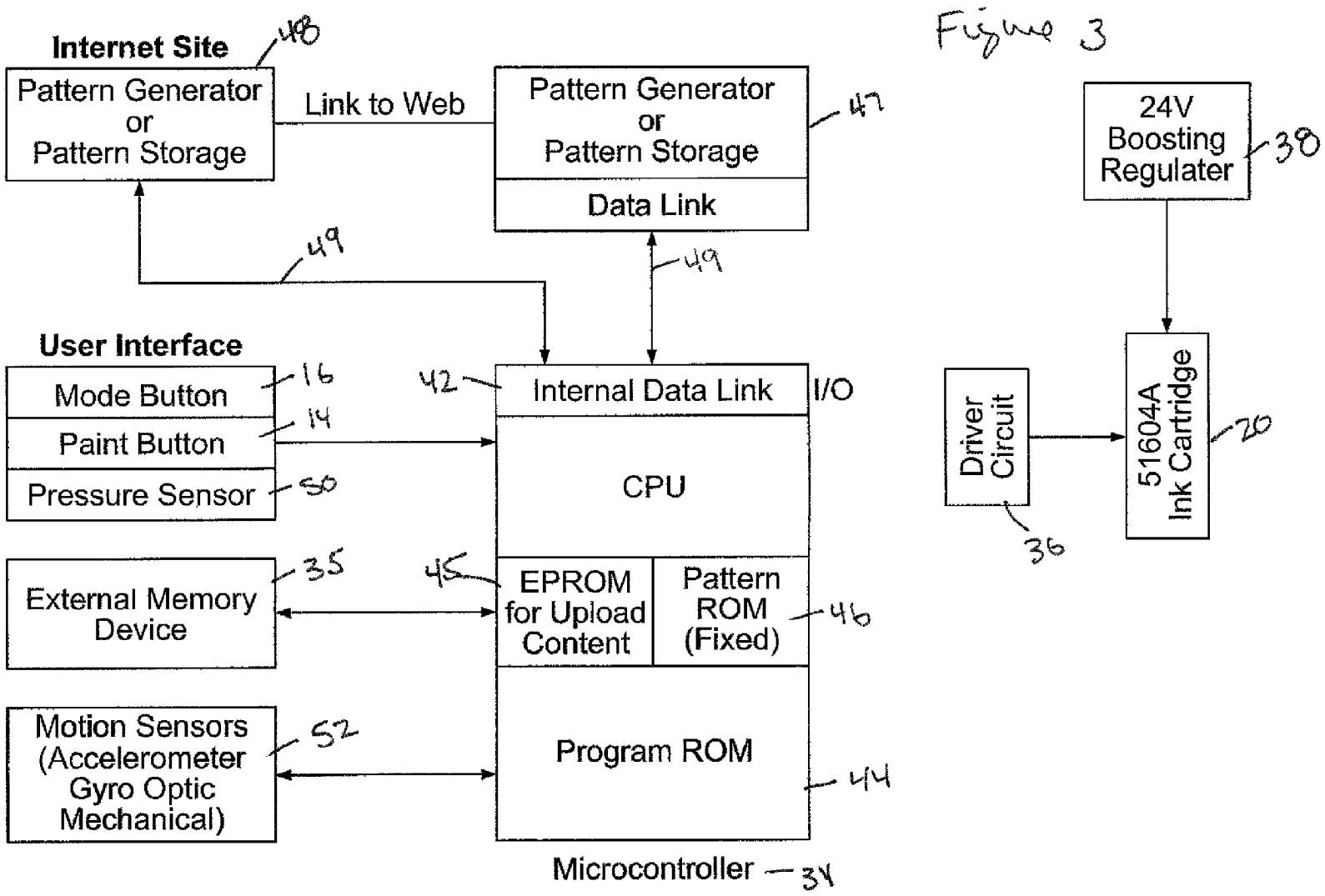
FIG. 3 is a block diagram that may be employed for one embodiment of the present invention.

Further shown in FIG. 3, the microcontroller 34 is capable of having memory components 44 or be permitted to read removable media 44, such as SD cards, EEPROM, ROMS, etc which could store bitmap pattern content. Removable media could then be customized via a PC using a proprietary pattern generating program, or any paint program. Therefore, the user can create a pattern using MS Paint included with windows OS, illustrated in FIG. 5*a*. The user could save the pattern on the SD card with a file name. The SD Card would then be inserted into a slot 45 on the airbrush pen. Now the pattern will be selectable by the user using selection button 16. In addition or separate therefore, the microcontroller 34 could have internal fix memory 46 with patterns pre-programmed.

An internal data link such as the USB port can be used to communicate to a computer 47 and link to the internet 48 (either through the computer or directly thereto) such that patterns can be generated, downloaded and then stored on the device, illustrated in FIG. 3. While a wired connection to a USB port can be used, wireless communication can also be employed 49.

The present invention airbrush can hold many preprogrammed designs and air brush spray patterns in an internal memory. The number of patterns is dictated only by the memory utilized in its electronic controls. The patterns could be selectable by the pattern selector switch(s) 16 on the outside of the device 10 or sequentially selected by a mode button, or by other interface means. After the pattern is selected, the spray button 14 is pressed and the inkjet starts to spray the pattern. It may be up to the user to control the distance and rate of movement of the airbrush to attain the desired effect. However, spray control could be attained by incorporating a pressure sensor 50 on the face of the inject device that sprays the ink. The pressure sensor 50 senses the pressure applied to control the width of the ink line and or the weight of the ink line's darkness. In another embodiment, a motion feedback system 52 is implemented so the electronic controls can monitor the movement of the device 10. The spacing between ink drops could be automatically adjusted to keep the patterns in perfect aspect no matter how much the user changes the speed of movement while spraying. This feedback system would use optical sensors or mechanical sensors much like a computer mouse, or could use accelerometers or gyros and the likes to monitor movement.

The device could be implemented with a multicolor ink cartridge. Multicolor ink cartridges use 3 or more columns of inkjets each spraying its own color which the electronics control the amount of ink and pattern for each color simultaneously digitally mixing the color to get virtually any color. Another implementation would use food safe food coloring for printing on food. This would have great uses in decorating foods, plates, ice, etc. Another implementation could use water based glue in place of the ink. Then you could spray a glue image and cover in glitter to create glitter images.

The styling of the housing of the device could take many forms including but not limited to a large pen shape, a spray paint can shape, a paint brush shape, or any other hand held ergonomic shape. The device can be used for many applications in many different markets. It can be used on almost every surface, and further it is not limited to flat surfaces. It is useful in all applications where custom labeling, decorating, painting, stamping, or "stickering" is desired on any material surface of any shape contour and size.

Beyond its artistic use as a digitally controlled airbrush for use on canvas or paper, it can be used simply as a pen or marker, or like spray paint. It can be used to label anything. It can be used as an alternative to rubber stamping. It could be used to non-permanently tattoo skin, decorate fingernails. It could be used to apply mailing addresses to envelopes or packages. It could be used to time date stamp perishable items in the restaurant industry. It could be used to spray food coloring on cookies, cakes, and other food items. It could be used to spray a water soluble adhesive to adhere glitter to make glitter images. This could replace the use of stickers, by teachers and children alike. It could be used as a calligraphy pen. It could be used to mark fabrics, and other textiles.

The device could also be programmed to print various images based on the activation of a spray button. For example, when spraying the image of a snake, the snake has three components, the head, body, and tail. The user initially presses the spray button to begin the spraying of a head; holding the button will continue spraying the body; and the release of the button will cause the airbrush to spray a tail. The length of the body can change simply by holding the button down for a longer or shorter period of time. The airbrush can also be programmed to follow this in two steps as opposed to three steps as explained above. For example, the spraying of a simply arrow (without a tail). The body of the arrow begins and continues by holding the button, and the release of the button causes the airbrush to spray an arrow head.

In one example, the device works with an inexpensive off the shelf ink cartridge such as a 51604A inkjet cartridge. This cartridge has 12 jets and its paint swath is ⅛" tall when very close to the paper. The jets also print in a single column. The inkjet squirts ink by applying a 24V pulse of 5 μs to any one of the 12 jets. The jets can only be fired 2 at a time in a specific order 1 and 7, 2 and 8, 3 and 9, 4 and 10, 5 and 11, 6 and 12. After a whole column has been printed there needs to be a 500 μs delay then the next column can be printed. An 8-bit microcontroller with 16 I/O is capable of driving the cartridge. It will need to run at 8 MHZ or better and need something like 8K of ROM and a few bytes of RAM. The driver transistors need to be able to supply 300 ma for 5 μs pulses. These drive transistors can be discreet transistors or could be replaced by transistor array chips like the ULN2803A. If the airbrush uses an USB data link version a microcontroller chip that supports USB directly or one that has a UART serial port would be connected to a USB converter chip like the FTD232R.

Figure 4A:
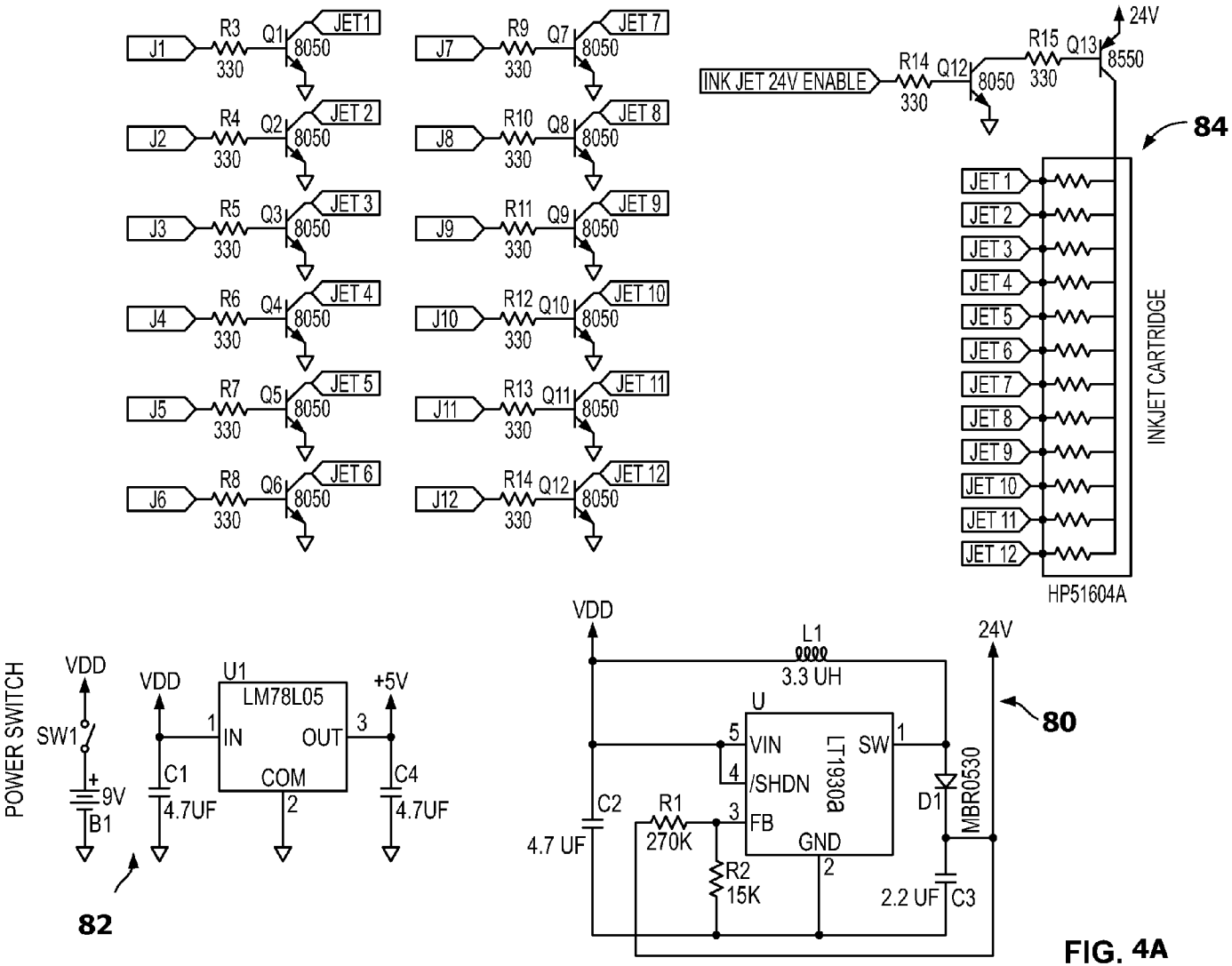
FIGS. 4A and 4B are block schematic diagrams of circuit that may be employed by an embodiment of the present invention.
Figure 4B:
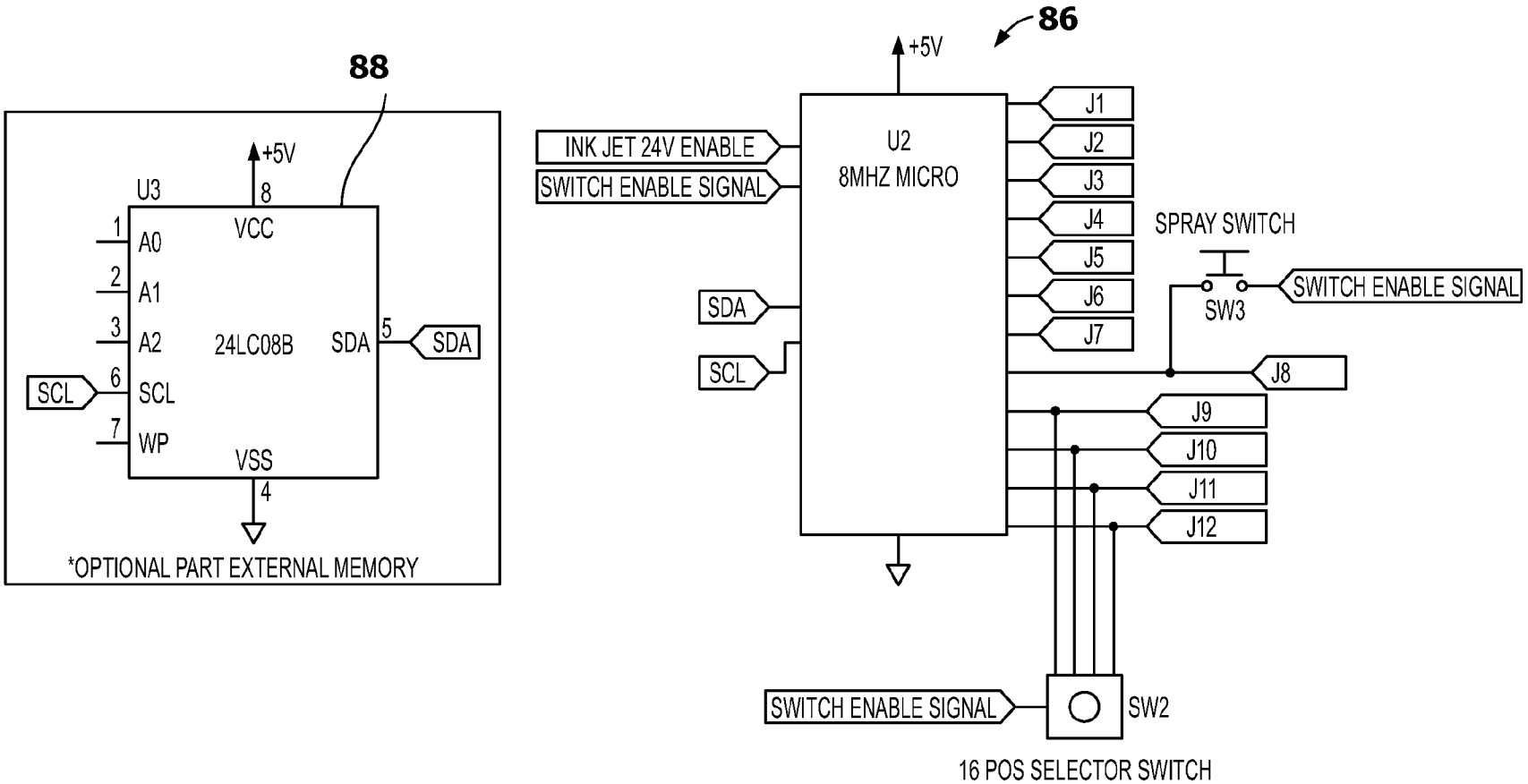

Referring now to FIGS. 4A and 4B, there is shown schematic diagrams for one of the embodiments of the present invention. The diagrams shows in 80 the schematic of a 24 voltage boosting regulator, and a 5 volt regulator in 82. The inkjet cartridge 84 which utilizes the 24 voltage boosting regulator is shown with its 12 jet pins that are further shown connected to pins j1 through j12. The j1 through j12 pins are relayed in FIG. 4B as being connected to the microcontroller 86, which is also powered by the 5 volt regulator 110. The microcontroller 86 includes the selector switch SW2 and the spray switch SW3, which are both illustrated as using the same I/O pins as j8 through 12. To enable the switches, the inkjet is disabled and the switch is then enabled. To fire the jets the inkjet would then be enabled while disabling the switches. In addition, an optional expanded memory chip is shown 88.

Figure 5A:
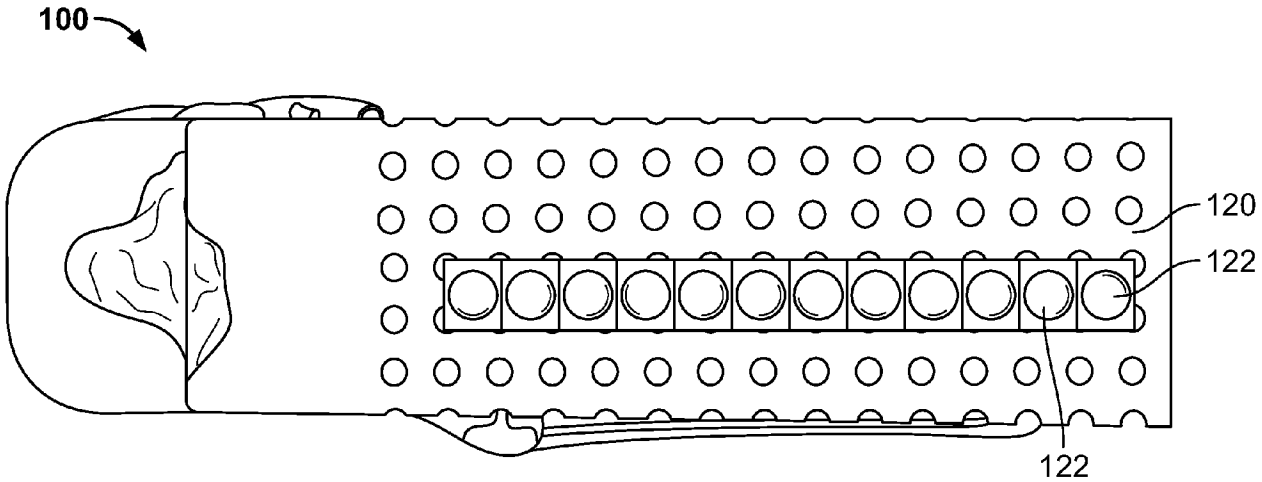
FIG. 5A is a front end view of a glow writing apparatus showing an LED light array used to draw an image on a ultraviolet sensitive surface.
Figure 5B:
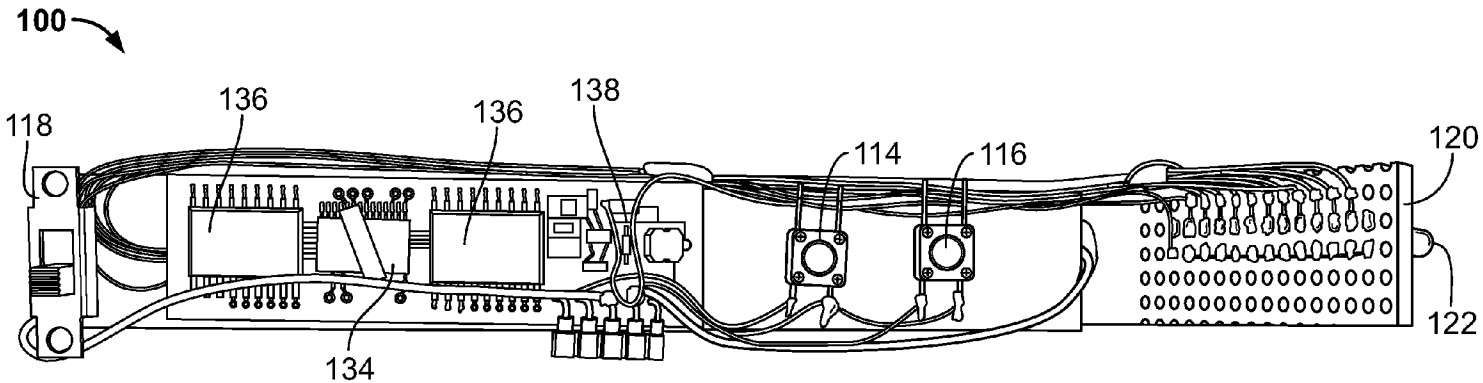
FIG. 5B is a top view of the apparatus from FIG. 5A illustrating the internal hardware components in accordance with the one embodiment of the present invention.
Figure 5C:
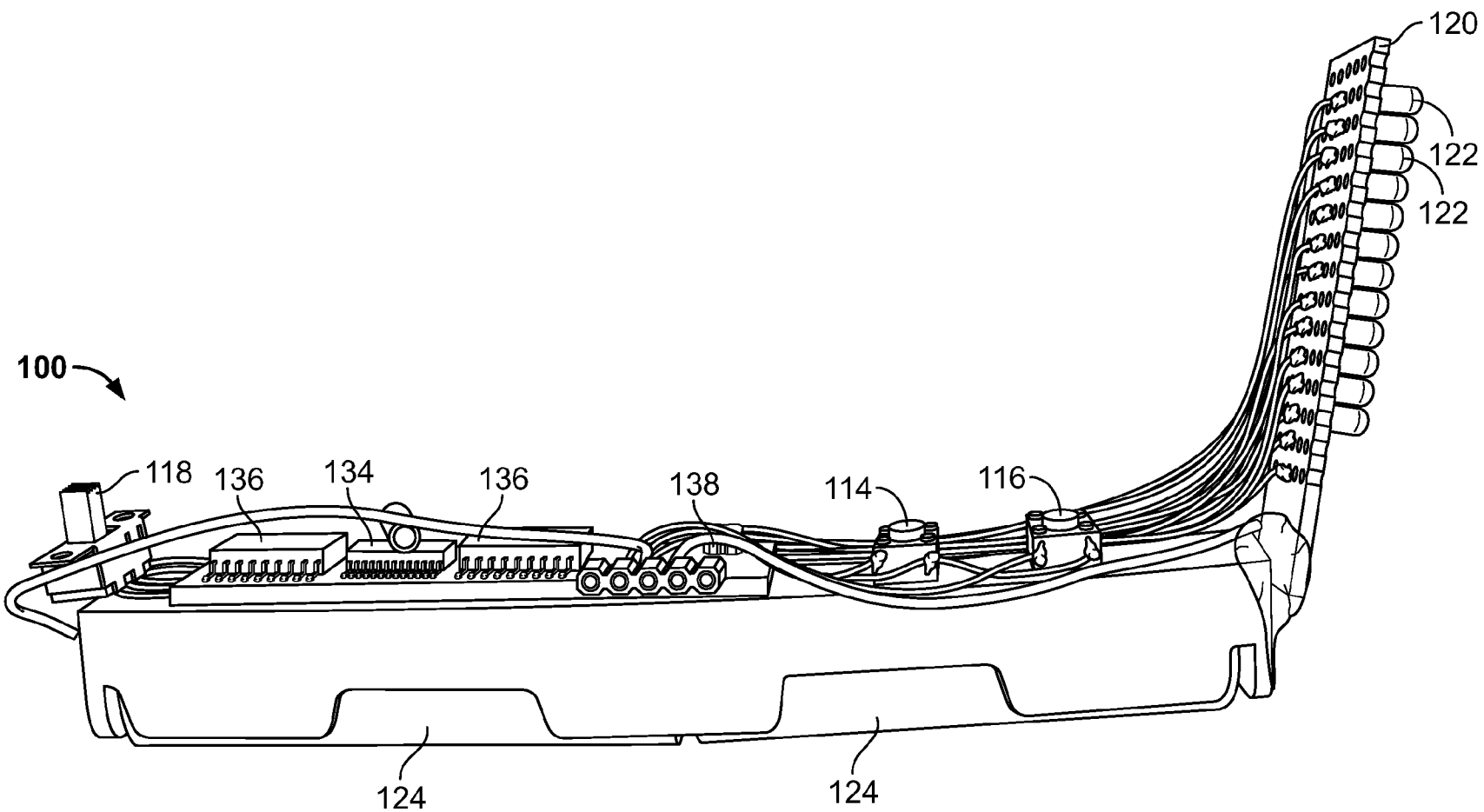
FIG. 5C is a side view of the apparatus from FIG. 5A illustrating the internal hardware components in accordance with the one embodiment of the present invention.
Figure 8:
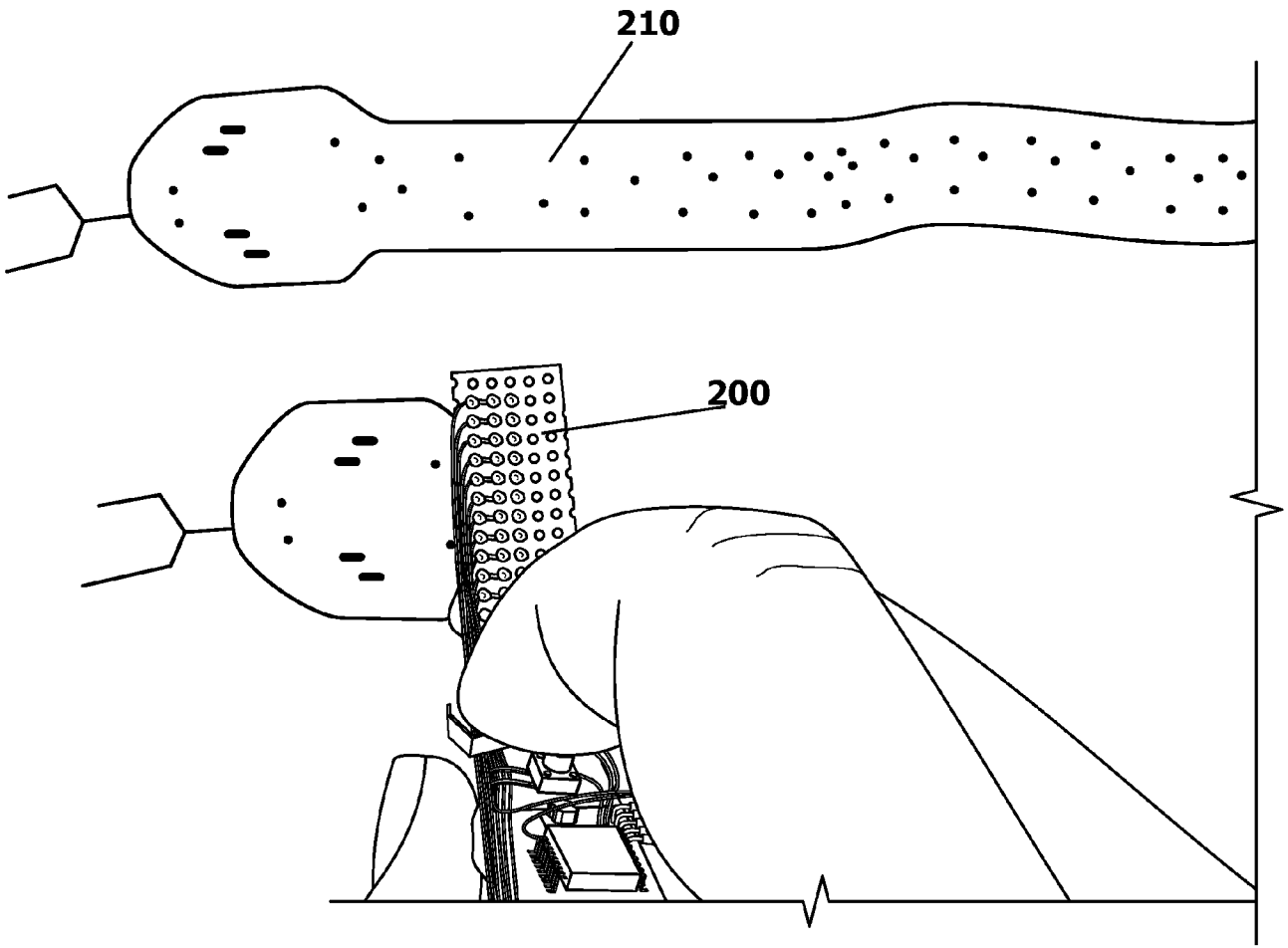
FIG. 8 is a representation of an ultraviolet sensitive surface having an image pattern being drawn thereon.

Referring now to FIGS. 5A through 5C, there is provided a second preferred embodiment as a hand held glow writing apparatus 100. The glow writing apparatus is a digital airbrush that uses light to freehand paint digital images on light sensitive materials. The glow writing apparatus will "paint" on any ultraviolet sensitive surface such as a glow in the dark surface other wise known as a phosphorescent surface, or UV monochromatic color changing surface otherwise known as a photochromic surface (See FIG. 8).

The glow writing apparatus uses a column of LEDs, located on the apparatus so as to shine on a light sensitive drawing surface. Further to maintain the proper image geometry the LEDs are oriented perpendicularly to its direction of motion. So when the brush is activated and being moved across the drawing surface its LEDs are flashed in sequence according to the image that is being created. So as it travels across a phosphorescent surface. It creates a glowing bitmap on the surface behind. Alternatively, when the glow writing apparatus is used with a photochromic surface it leaves a monochromatic bitmap that can be seen in full room light. Typically the image is blue on a white background. UV or Blue LEDs will work with the glow in the dark material. UV results in a brighter glow, but Blue are generally less expensive. Only UV LEDS will work with the white to blue color change material. After a period of time the image fades allowing the user to re-use the drawing surface.

The apparatus 100 comprises, in general a trigger switch 114, a pattern selector switch 116, an on/off switch 118, and a LED array 120. As further disclosed herein below, the device 100 uses an array of LED lights 122 which are controlled under a predetermined timing sequence by a internal microcontroller, which when used in connection with a specific light sensitive surface will leave a lighted image of the surface that will fade over time. The lighted image can be any type of image or text.

The LED array 120 is depicted as a single series of individual LED lights 122. However, it is possible to synchronize multiple series of LED lights.

The microcontroller 134 controls and communicates with the various components of the device 10, including the on/off switch 118, the pattern selector 116, the LED activation switch 114, LED drivers 136, and an optional boosting regulator 138. The boosting voltage regulator 138 converts standard battery voltage to an appropriate voltage used by the LED array, in some embodiments the voltage may be between 3 and 24 volts. A battery pack 124 is also provided to power the device 100. The microcontroller 134 is capable of having memory components or be permitted to read removable media, such as SD cards, EEPROM, ROMS, etc which could store bitmap pattern content. Removable media could then be customized via a PC using a proprietary pattern generating program, or any paint program. Therefore, the user can create a pattern using a program. The user could save the pattern on the SD card with a file name. The SD Card would then be inserted into a slot on the apparatus. Now the pattern will be selectable by the user using selection button 116. In addition or separate therefore, the microcontroller 134 could have internal fix memory with patterns pre-programmed.

An internal data link such as the USB port can be used to communicate to a computer and link to the internet (either through the computer or directly thereto) such that patterns can be generated, downloaded and then stored on the device. While a wired connection to a USB port can be used, wireless communication can also be employed.

Figure 6A:
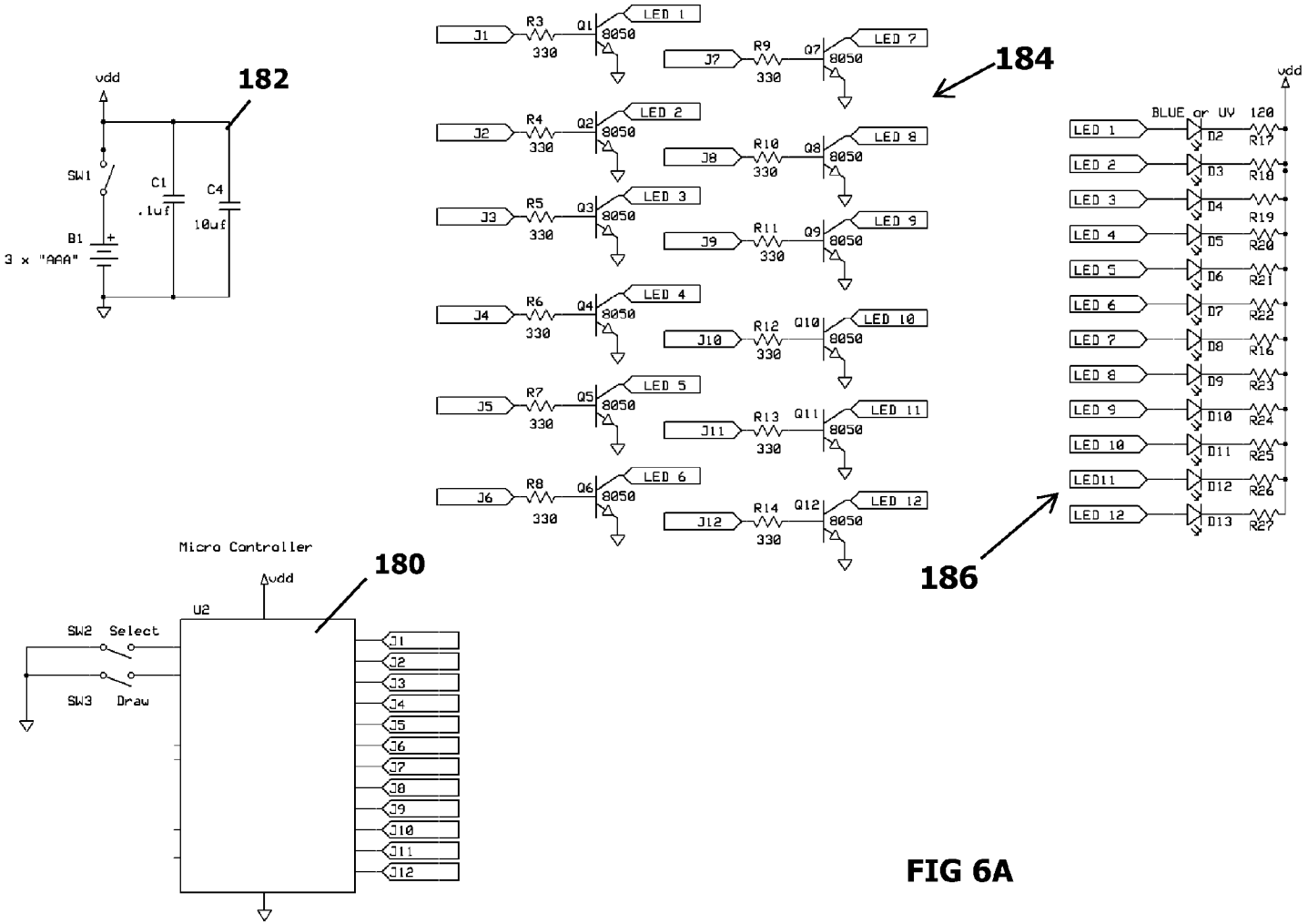
FIG. 6A are block schematic diagrams of circuit that may be employed by an embodiment of the FIG. 5A apparatus.
Figure 6B:
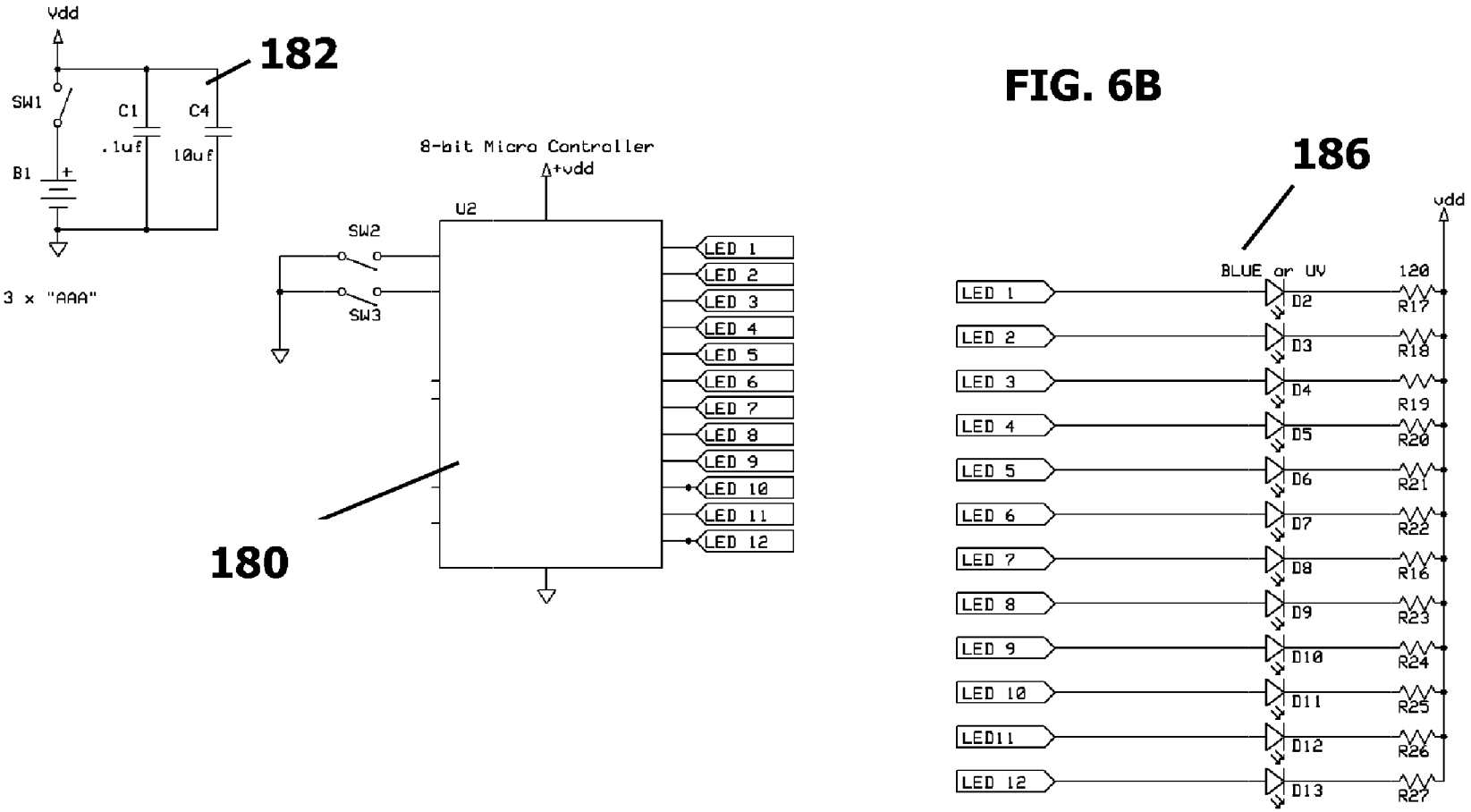
FIG. 6B are block schematic diagrams of circuit that may be employed by an embodiment of the FIG. 5A apparatus.

Referring now to FIG. 6A, there is shown schematic diagrams for the hand held glow writing apparatus. The diagrams show a single circuit board design 180 with a 0.020 amp max current to the LEDs. The microcontroller 180 utilizes a voltage regulator 182 and driver transistors 184 to operate the LEDs 186. As shown the 12 LEDs are connected to pins j1 through j12, which are relayed to the microcontroller. Alternatively, in FIG. 6B, the microcontroller 180 could operate the LEDs 186 without the driver transistors.

To enable the LEDs, the user presses the trigger switch to begin strobing the LEDs in sequence in accordance to the bit map pattern, done in a column by column fashion. The time in which the column of LEDs are maintained in an on position and the speed in which the user moves across the page will either stretch or narrow the glow print.

Figure 7:
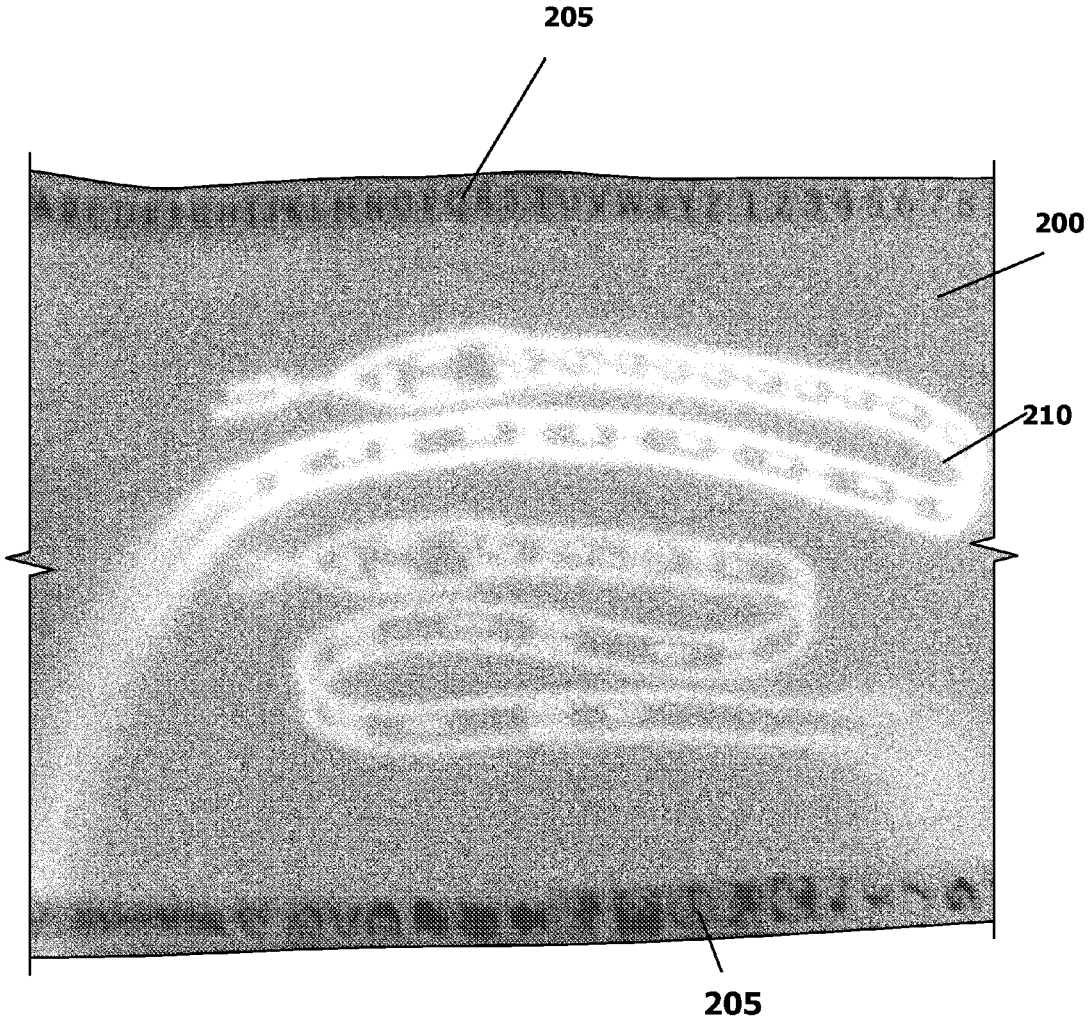
FIG. 7 is a representation of an ultraviolet sensitive surface having embedded image switches.

Content could be selected by simply pressing a button on the glow writing apparatus, or with the use of wireless, magnetic, or mechanical switches, or IR or RF id tags. Specific sections of the drawing surface could select content automatically. For example, in FIG. 7, the top and/or bottom of the drawing surface 200 could include images or text 205 embedded with a tag or switch. The user would simply bring the writing apparatus up to the desired image or text, passing a sensor over the embedded tag or switch and them the image content already stored on the writing apparatus would activate. Alternatively, the images or text could include an embedded transmitter that sends the image information to the writing apparatus. Further if an IR receiver is added to the writing apparatus the printed images could be wirelessly selected. For example images could be selected by a press of a button on a remote control. Or the drawing surface could contain electronics so it can act as a remote control. Add on drawing surfaces or art palates sold separately could have unique content contained in them too.

In one embodiment, a hand-held glow writing apparatus 100 is constructed for use with an ultraviolet sensitive surface 200 to produce images 210 that glow in the dark and will fade over a time period. The device 100 includes a microcontroller 134 having at least a memory and a predetermined timing sequence program. The memory is capable of storing at least one image pattern. An LED array 120 is positioned on an end of the apparatus 100. The LED array 120 has at least one column of a plurality of LED lights 122 arrange in a parallel line. A plurality of discrete drivers 184 separately coupled to the LED lights 120 are selectively actuatable by the microcontroller 134 for activating the LED lights. A selector switch is provided 114 for electively choosing one of the at least one image patterns stored on the memory. In addition, an activation switch 116 is provided for selectively actuating the discrete drivers to activate the LED lights in accordance with the predetermined timing sequence, such that the LED lights will flash on and off in a sequence timed for a movement of the writing apparatus across ultraviolet sensitive surface whereby the selected image pattern will imprint an image on the ultraviolet sensitive surface that fades over the time period.

In another embodiment, a hand-held glow writing apparatus 100 is constructed for use in combination with an ultraviolet sensitive surface 200 to produce images that glow in the dark and will fade over a time period. The combination includes the hand-held glow writing apparatus 100, that would have a microcontroller with at least a memory and a predetermined timing sequence program. The memory storing at least two image patterns. The apparatus includes a device image switch, which when triggered selectively chooses an image pattern stored on the memory. An activation switch is also provided for selectively activating the LED lights in accordance with the predetermined timing sequence, such that the LED lights will flash on and off in a sequence timed for a movement of the writing apparatus across ultraviolet sensitive surface whereby the selected image pattern will imprint an image on the ultraviolet sensitive surface that fades over the time period. In addition, there is provided the ultraviolet sensitive surface having at least one surface image switch embedded under an image representation. The image representation corresponding to an image stored on the memory in the hand-held glow writing apparatus, wherein when the device image switch moves into proximity to the surface image switch, the surface image switch triggers the device image switch such that when the activation switch is actuated, the writing apparatus will imprint the image corresponding to the image representation.

Pattern Code for Glow Brush

```
//110 wide 220 bytes
const unsigned char printerpen[ ]={
0,224,24,4,212,202,10,202,212,4,
24,224,0,0,0,0,206,107,59,17,
```

-continued

```
145,129,135,142,126,51,3,1,209,217,
63,254,254,227,1,3,230,254,254,227,
3,1,63,158,198,1,1,227,254,254,
102,99,1,51,159,62,1,3,247,255,
243,193,3,159,159,25,129,241,255,11,
73,237,205,193,243,255,248,96,124,126,
3,57,61,127,248,248,204,12,166,166,
162,227,243,255,255,1,195,223,142,99,
241,249,153,13,7,3,0,0,0,0,
0,0,3,5,5,9,9,9,5,5,
3,0,0,0,0,0,1,3,6,4,
12,8,8,9,11,14,6,4,6,6,
6,3,15,9,13,13,7,3,1,7,
4,6,2,7,6,4,6,1,1,3,
6,6,4,7,7,4,4,6,6,14,
15,11,8,9,12,14,7,1,1,3,6,
4,5,4,6,7,6,4,6,15,8,
15,15,6,6,4,7,6,6,12,12,
8,13,15,3,2,13,9,9,12,7,
3,1,0,0,0,0,0,0,0
};
const unsigned char skull[ ]={
25,27,10,138,94,138,10,27,25,0,
  0, 0, 7, 13,15, 13, 7, 0, 0,0
};
const unsigned char people[ ]={
0x11,   0x11,   0x97,   0x54,0x7c,0x54,0x97,0x11,0x11,
   0, 0x03, 0x04, 0x08,0x08,0x08,0x04,0x03,0
};
const unsigned char brush1[ ]={0x80,0};
const unsigned char brush2[ ]={0xc0,0};
const unsigned char brush3[ ]={0xe0,0};
const unsigned char brush4[ ]={0xf0,0};
const unsigned char brush5[ ]={0xf8,0};
const unsigned char brush6[ ]={0xfc,0};
const unsigned char brush7[ ]={0xfe,0x00};
const unsigned char brush8[ ]={0xff,0x00};
const unsigned char brush9[ ]={0xff,0x01};
const unsigned char brush10[ ]=[0xff,0x03};
const unsigned char brush11[ ]={0xff,0x07};
const unsigned char brush12[ ]={0xff,0x0f};
const unsigned char Aee[ ]={
   0x0f,0x7f,0xf0,0xb0,0x30,0x30,0x30,0xb0,0xf0,0x7f,0x0f,
   0x00,0x00,0x01,0x07,0x0e,0x0c,0x0e,0x07,0x01,0x00,0x00};
const unsigned char Bee[ ]={
   0xff,0xff,0x63,0x63,0x63,0x63,0x63,0x63,0xb7,0x3e,0x1c,
   0x0f,0x0f,0x0c,0x0c,0x0c,0x0c,0x0c,0x0c,0x07,0x03,0x00
   };
const unsigned char Cee[ ]={
   0xf0,0xfc,0x0e,0x03,0x03,0x03,0x03,0x03,0x03,0x0e,0x0c,
   0x00,0x03,0x07,0x0c,0x0c,0x0c,0x0c,0x0c,0x0c,0x07,0x03
};
const unsigned char g2[ ]={
24,188,236,12,108,76,70,67,65,65,70,108,56,2,7,13,153,217,218,74,
105,45,133,197,101,61,25,1,1,0,0,0,0,12,234,2
5,1,12,249,35,60,0,128,56,60,254,254,252,220,224,56,254,255,126,
60,16,0,128,224,240,127,254,252,224,0,0,0,0,0
,0,48,24,220,252,188,6,190,159,15,14,6,4,0,0,128,56,60,254,254,
252,220,224,56,254,255,126,60,16,0,128,128,66,
130,255,7,192,128,128,0,0,8,12,252,255,247,62,24,0,0,60,126,254,
207,143,207,255,63,31,6,0,128,56,60,254,254,2
52,220,224,56,254,255,126,60,28,252,254,254,191,255,248,224,
128,0,0,0,0,0,0,0,0,
7,13,6,2,6,12,12,12,8,8,9,11,14,4,0,3,7,12,8,8,6,3,1,0,0,0,0,0,0,0,0,0,
0,0,9,7,9,9,9,11,4,0,1,3,3,7,7,3,3,0,0,15,5,0,0,8
,15,7,7,7,0,8,15,15,14,12,10,10,12,0,0,0,1,1,1,3,3,3,7,6,4,0,0,0,1,3,3,
7,7,3,3,0,0,15,5,0,0,8,7,7,3,3,15,7,3,1,1,3,3,4,0
,3,11,13,13,12,0,0,14,15,4,0,3,3,7,3,1,1,0,0,1,3,3,7,7,3,3,0,0,15,5,0,0,
0,1,3,7,12,14,14,12,8,0,0,0,0,0,0,0,0,
};
//39 long
const unsigned char snakehead[ ]={
36,4,68,4,148,4,36,4,68,4,148,4,4,36,134,18,1,1,1,1,1,5,13,9,1,2,82,
4,8,240,32,32,32,80,136,136,136,136,8,
2,2,2,2,2,2,2,2,2,2,2,2,2,2,6,4,9,8,8,8,8,10,11,9,8,4,4,2,1,0,0,0,0,0,0,
0,0,0,0
};
//6 long
const unsigned char snakebody[ ]={
36,4,68,4,148,4,2,2,2,2,2,2};
```

-continued

```
//32 long
const unsigned char snaketail[ ]={
64,96,96,96,144,240,144,240,144,240,144,240,152,248,8,104,8,168,
12,108,4,244,12,244,4,4,4,4,4,4,4,4,
0,0,0,0,0,0,0,0,0,0,0,0,1,1,1,1,1,1,3,3,2,2,3,2,2,2,2,2,2,2,2,2,2,
};
```

Glow Brush Main Function

```
Void main(void)
{
while (1)
{
  if(!RB6)
  {
    DelayMs(100);
    while(!RB6);
    mode++;
    if(mode>7)mode=0;
  }
  if(!RB7)
  {
    DelayMs(100);
    do
    {
      switch(mode)
      {
        case 0: printBmp(Aee,11,0,160,40,0,0);
  break;
        case 1: printBmp(Bee,11,0,160,40,0,0);
  break;
        case 2: printBmp(Cee,11,0,160,40,0,0);
  break;
        case 3:
        printBmp(Cee,11,0,20,40,0,0);
    printBmp(Aee,11,0,20,40,0,0);
    printBmp(Bee,11,0,160,40,0,0);
        break;
        case 4:printBmp(snakehead,39,0,0,40,0,1);
          do{
            printBmp(snakebody, 6,0,0,40,0,1);
          }while(!RB7);
          printBmp(snaketail,32,0,0,40,0,1);
        break;
        case 5: printBmp(people,9 ,0, 8,40,1,0);
  break;
        case 6:printBmp(brush3,1 ,0, 0,40,1,0);
  break;
        case: printBmp(printerpen,110,0,50,40,1,0);
  break;
        }
      }while(!RB7);
    }
  }
}
```

Flash Sequence and Timing Code

```
//size is width of bmp
//delay is the delay between columns
//delay 1 is a delay after the image is comlete
//repeat is repetitions of each column
//stp mode prints while button is held
void printBmp(const unsigned char *c,unsigned char size, unsigned char
delay,unsigned char delay1,unsigned char repeat,unsigned char
stp,unsigned char reverse) {
char Z,x,rpt,dly;
unsigned char mask;
unsigned int temp;
unsigned char RCbyte,RBbyte;
if (repeat==0)repeat=1;
    if (!reverse)
    {
        for(Z=0;(Z<size)&&((!RB7&stp) || !stp);Z++)
        {
            RCbyte = c[Z] & 0x3f;
            RBbyte = (c[Z] & 0xc0)>>6;
            temp = size+Z;
            RBbyte | = ((c[temp]&0x0f)<<2);
            mask=0x3F;
        rpt=repeat;
            do
            {
                PORTC=mask&RCbyte;
                PORTB=mask&RBbyte;
                DelayMs(1);
            }while(--rpt&&((stp&!RB7) || (!stp)));
            for(dly=0;dly<delay;dly++)
            {
                PORTC=0x00;
                PORTB=0x00;
                DelayMs(1);
            }
        }
    }
    else
    {
        for(Z=size−1;(Z>0)&&((!RB7&stp) || !stp);Z--)
        {
            RCbyte = c[Z] & 0x3f;
            RBbyte = (c[Z] & 0xc0)>>6;
            temp = size+Z;
            RBbyte | = ((c[temp]&0x0f)<<2);
            mask=0x3F;
        rpt=repeat;
            do
            {
                PORTC=mask&RCbyte;
                PORTB=mask&RBbyte;
                DelayMs(1);
            }while(--rpt&&((stp&!RB7) || (!stp)));
            for(dly=0;dly<delay;dly++)
            {
                PORTC=0x00;
                PORTB=0x00;
                DelayMs(1);
            }
        }
    }
    PORTC=0x00;
    PORTB=0x00;
    for(dly=0;dly<delay1;dly++)
    {
        DelayMs(1);
    }
}
```

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A hand-held glow writing apparatus constructed for use with an ultraviolet sensitive surface to produce images that glow in the dark and will fade over a time period, said device comprising:

a microcontroller having at least a memory and a predetermined timing sequence program, the memory capable of storing at least one image pattern;

an LED array positioned on an end of the apparatus, the LED array having at least one column of a plurality of LED lights arrange in a parallel line;

a plurality of discrete drivers separately coupled to the LED lights, said drivers being selectively actuatable by the microcontroller for activating the LED lights;

a selector switch for electively choosing one of the at least one image patterns stored on said memory; and an activation switch for selectively actuating said discrete drivers to activate the LED lights in accordance with the predetermined timing sequence, such that the LED lights will flash on and off in a sequence timed for a movement of the writing apparatus across ultraviolet sensitive surface whereby the selected image pattern will imprint an image on the ultraviolet sensitive surface that fades over the time period.

2. The device of claim 1, wherein the memory has stored at least two image patterns.

3. The device of claim 1, wherein the selected image pattern has multiple component images, and the activation and deactivation of the activation switch is capable of rendering different component images of the selected image pattern.

4. The device of claim 1, wherein the LED array includes a second column of a plurality of LED lights arrange in a line parallel to the first column.

5. In combination, a hand-held glow writing apparatus constructed for use in combination with an ultraviolet sensitive surface to produce images that glow in the dark and will fade over a time period, said combination comprising:

the hand-held glow writing apparatus, including:

a microcontroller having at least a memory and a predetermined timing sequence program, the memory storing at least two image patterns;

an LED array positioned on an end of the apparatus, the LED array having at least one column of a plurality of LED lights arrange in a parallel line;

a plurality of discrete drivers separately coupled to the LED lights, said drivers being selectively actuatable by the microcontroller for activating the LED lights;

a device image switch, which when triggered selectively chooses an image pattern stored an said memory;

an activation switch for selectively actuating said discrete drivers to activate the LED lights in accordance with the predetermined timing sequence, such that the LED lights will flash on and off in a sequence timed for a movement of the writing apparatus across ultraviolet sensitive surface whereby the selected image pattern will imprint an image on the ultraviolet sensitive surface that fades over the time period; and the ultraviolet sensitive surface including:

at least one surface image switch embedded under an image representation, the image representation corresponding to an image stored on the memory in the hand-held glow writing apparatus, wherein when the device image switch moves into proximity to the surface image switch, the surface image switch triggers the device image switch such that when the activation switch is actuated, the writing apparatus will imprint the image corresponding to the image representation.

6. A hand-held glow writing apparatus constructed for use with an ultraviolet sensitive surface to produce images that glow in the dark and will fade over a time period, said device comprising:

a microcontroller having at least a memory and a predetermined timing sequence program, the memory capable of storing at least one image pattern;

an LED array positioned on an end of the apparatus, the LED array having at least one column of a plurality of LED lights arrange in a parallel line;

a selector switch for electively choosing one of the at least one image patterns stored on said memory; and an activation switch for selectively actuating the LED lights in accordance with the predetermined timing sequence, such that the LED lights will flash on and off in a sequence timed for a movement of the writing apparatus across ultraviolet sensitive surface whereby the selected image pattern will imprint an image on the ultraviolet sensitive surface that fades over the time period.

* * * * *